US005303135A

United States Patent [19]

Sprecher

[11] Patent Number: 5,303,135

[45] Date of Patent: Apr. 12, 1994

[54] REDUCED-GLARE HEADLIGHTS

[76] Inventor: Meir Sprecher, 49 Hagalil Street, 43251 Raanana, Israel

[21] Appl. No.: 948,532

[22] Filed: Sep. 22, 1992

[51] Int. Cl.[5] ..... F21V 7/00

[52] U.S. Cl. ..... 362/301; 362/292; 362/342; 362/346

[58] Field of Search ..... 362/297, 61, 279, 290, 362/292, 298, 301, 303, 310, 325, 342, 359, 346

[56] References Cited

U.S. PATENT DOCUMENTS

| | | | |
|---|---|---|---|
| 1,357,034 | 10/1920 | D'Humy | 362/298 |
| 1,413,415 | 4/1922 | McPeek | 362/342 |
| 1,513,683 | 10/1924 | Westover | 362/290 |
| 1,618,010 | 2/1927 | Hoss | 362/310 |
| 2,277,563 | 3/1942 | Scott et al. | 362/298 |
| 4,480,291 | 10/1984 | Dranginis | 362/342 |
| 5,083,245 | 1/1992 | Fray et al. | 362/61 |

FOREIGN PATENT DOCUMENTS

| | | | |
|---|---|---|---|
| 1330598 | 5/1963 | France | 362/298 |
| 0128103 | 10/1928 | Switzerland | 362/298 |

*Primary Examiner*—Richard R. Cole
*Assistant Examiner*—Alan B. Cariaso
*Attorney, Agent, or Firm*—Mark M. Friedman

[57] ABSTRACT

A glare-reducing light source, useful as an automobile headlight featuring a conventional horizontal collimated light beam. The entire collimated light beam is reflected by set of reflective slats. The reflected light is then reflected again by a single reflector onto a second set of reflective slats which directs the light to the desired location in front of the automobile headlights. The headlight is designed so that no light is able to leave the headlight at an angle which will allow light to impinge the eyes of the driver of an oncoming car.

7 Claims, 2 Drawing Sheets

REDUCED-GLARE HEADLIGHTS

FIELD AND BACKGROUND OF THE INVENTION

The present invention relates to automobile headlights and, more particularly, to automobile headlights which are perceived by drivers of oncoming cars as having no glare or greatly reduced glare.

The problem of automobile headlight glare is well known to everyone who has ever driven an automobile at night. The problem is particularly acute on undivided roads where only a few centimeters separate cars, and their headlights, as they pass each other heading in opposite directions.

In nighttime driving, the eyes of the driver get adjusted to the generally low level of illumination. This is typically accomplished by an automatic physiological reaction which causes the irises to open widely. In this condition, the eyes of the driver are able to perceive objects on and around the roadway which are poorly illuminated. The driver's night vision is generally not impaired by the tail lights of cars heading in the same direction since such lights are generally of relatively low intensity.

However, the situation is dramatically different whenever the subject driver encounters an approaching car, especially when the approaching car is heading parallel to the car of the subject driver on a course which will bring the two cars in close proximity of each other. As the light from the headlights of an oncoming car impinge on the eyes of the subject driver, the irises of the subject driver automatically and suddenly constrict to decrease the amount of light entering the light.

In this state, all the subject driver is able to see are the headlights. With his irises constricted, the amount of light received by the subject driver from objects other than the headlights of the oncoming car is insufficient for the subject driver to perceive them. Hence, for a few seconds starting with the near approach of the oncoming car and ending with the disappearance of the oncoming car from view as it passes alongside the subject driver, the subject driver is effectively blinded and is at risk. Of course, the driver of the oncoming car faces exactly the same problem.

But the problem is, in fact, even more severe than indicated above. The reason is physiological. The human iris is designed to constrict quickly, typically in a fraction of a second, so as to quickly and effectively protect the eye from large amounts of illumination. Unfortunately, the dilation of the human iris is a much slower process, which can take several minutes. Thus, not only is the subject driver temporarily blinded as he sees the light from the oncoming car, but the subject driver continues to suffer from impaired vision for several minutes after the oncoming car has passed as his eyes strive to dilate sufficiently for his eyes to perceive the roadway in the best way possible.

Of course, on busy roadways where oncoming cars are encountered with great frequency, the irises of the subject driver never get a chance to reach their optimal dilation and the subject driver suffers continuously from impaired vision. When being exposed to these conditions, other physical disabilities may manifest themselves, such as headaches, and the like. These could further endanger the subject driver and all those in or near the roadway.

A number of techniques and devices have been used in an effort to combat the problems. One technique which is taught in driving schools is for the subject driver to avoid staring into the headlights of the oncoming car and, instead, to turn his glance away as much as can be done with safety as the oncoming car approaches.

A well-known method which is in widespread use in the vast majority of automobiles is the possibility of switching between low beam and high beam. Under normal conditions, such as when traveling in well-lit area, at relatively low speeds on heavily travelled roads, the low beams are used. However, when driving at high speeds on highways which are inadequately illuminated low beam headlights do not provide for proper illumination of the road sufficiently far ahead of the vehicle and high beams are required.

Most headlights manufactured today feature a glass or similar front plate which is configured, typically through the use of glass of varying thickness and diffraction angles, so as to reduce glare. For example, the front plate for use in cars where driving is done on the rights are designed to diffuse light which might otherwise be directed to the left and into the eyes of the drivers of oncoming cars.

The techniques and devices mentioned above, as well as others, while somewhat effective, still leave considerable room for improvement. That improvement is still needed can be seen from the well-known fact which has been repeatedly established statistically, that per mile travelled, the rate of occurrence of traffic accidents is much greater at night than during the day. While nighttime driving is generally more hazardous due to the generally reduced visibility, there is no question that the further impairment of vision caused by the glare of oncoming cars remains a significant cause of nighttime car accidents.

There is thus a widely recognized need for a reduced-glare automobile headlight which will significantly reduce or even eliminate the problems associated with present methods and techniques.

Various attempts have been made to design a reduced-glare automobile headlight. U.S. Pat. No. 1,166,685 disclosed a complicated headlight which features a visor extending over the top portion of the headlight and which requires repeated internal reflection of the light beam prior to its emergence from the headlight. U.S. Pat. No. 1,981,328 discloses a similar system which uses a pair of curved reflecting surfaces of unusual shapes.

There have been many attempts to design headlights with a series of anti-glare opaque or reflective slats disposed across the front of the headlight so as to block the light beam and direct it at the desired angles. Illustrative of this approach are U.S. Pat. Nos. 1,115,914, 1,265,258, 1,289,814, 1,309,447, 1,333,482, 1,413,415, 1,417,128, 1,421,847, 1,442,463, 1,445,282, 1,463,024, 1,495,099, 1,500,075, 1,542,059, 1,596,831, 1,618,010, 1,631,130, 1,637,622, 1,710,187, 1,767,590, 1,797,881, 1,868,995, 2,102,928, 2,119,370, 2,478,308 and 5,077,649. The difficulty with these design is that, in each, an attempt is made to bend a light beam which is essentially horizontal in such a way that the light is directed downward to a zone in front of the vehicle. However, as is explained in more detail below, in view of today's relatively high travel speeds, the light beam must be projected to a relatively large distance ahead of the car. Doing so requires that these slats be oriented at very small angles to the horizontal. This requirement, in turn, necessitates the use of slats which are inordinately long and thus renders headlights incorporating such slats impracticable.

It would be thus desirable and highly advantageous to have an automobile headlight which includes anti-glare slats and which i of approximately the same overall size and shape as conventional headlights.

SUMMARY OF THE INVENTION

According to the present invention there is provided a glare-reducing light source, comprising: (a) a means for producing a substantially horizontal light beam; (b) a first set of reflective slats for reflecting the light beam, forming a once reflected light; (c) a reflector for reflecting the once reflected light, forming a twice reflected light; and (d) a second set of reflective slats for reflecting the twice reflected light forming a thrice reflected light.

According to another embodiment of the present invention there is provided a glare-reducing light source, comprising: (a) a means for producing a collimated light beam; (b) a set of reflective slats for reflecting the light beam at an angle larger than about 30°.

According to further features in preferred embodiments of the invention described below, the first and second sets of reflective slats are of such an angle relative to the light beam and are of such a length that all of the light beam is reflected by both the first and the second sets of slats.

According to still further features in the described preferred embodiments the reflector is rotatable so as to afford the flexibility of aiming the exiting beam higher or lower.

The present invention successfully addresses the shortcomings of the presently known configurations by providing an automobile headlight which is of approximately the same size and shape as conventional headlights and which is capable significantly reducing or even completely eliminating glare.

The present invention discloses a novel automobile headlight which features two sets of slats and a reflector plate. A collimated light beam, such as is commonly used in conventional headlights, is made to impinge the first set of slats which of some suitable length and are oriented at a suitable angle with respect to the light beam as to intercept the entire light beam and reflect it toward a reflector. The reflector directs the once reflected light toward a second set of slats having a proper orientation and size so as to reflect the twice reflected light in a direction which will provide adequate illumination of an area in front of the headlight but which will not normally allow light rays to be directed in a direction which will impinge upon the eyes of a driver of an oncoming car.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a light source, such as an automobile headlight which is capable of preventing the emission of light rays in undesirable directions. Specifically, the present invention can be used as a glare-reducing or glare-eliminating automobile headlight.

While the present invention need not necessarily be confined to applications as an automobile headlight and can, for example, be used whenever it is desired to use a collimated light beam, such as, for example, as a directional flashlight or a street lamp, the discussion below is confined, without in any way limiting the scope of the present invention, to the application of the present invention in the field of glare-reducing automobile headlights.

The principles and operation of a glare-reducing automobile headlight according to the present invention may be better understood with reference to the drawings and the accompanying description.

Figure 1:
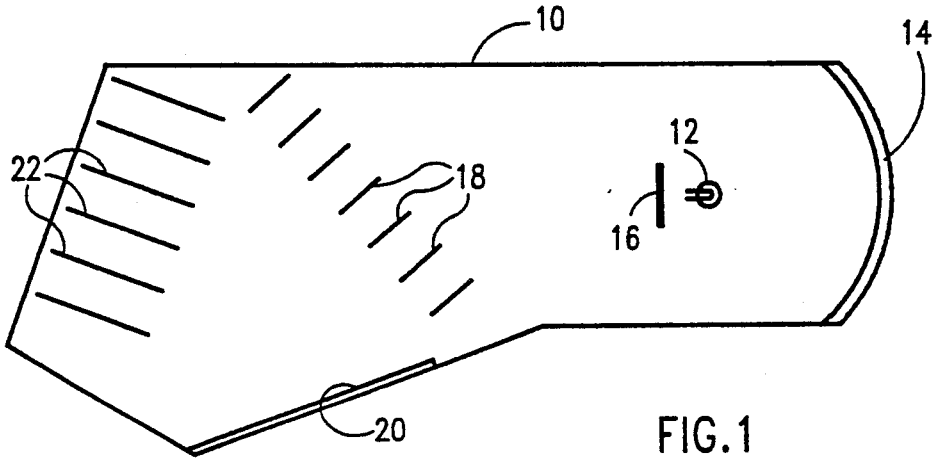
FIG. 1 is a side cross-sectional view of a light source according to the present invention, showing the two sets of slats and the reflector.

Referring now to the drawing, FIG. 1 illustrates in cross-sectional side view an automobile headlight according to the present invention. The headlight includes a housing 10 which may be made of any convenient material and which serves to contain the various components of the system.

Housing 10 contains means for producing a light beam. Preferably, the light beam produced is a collimated light beam. Use of a non-collimated light beam allows use of a variety of reflective mirrors and requires the use of slats, to be described below, which have compound curvature rather than being flat. For clarity of exposition, the description which follows is limited to collimated beams, it being understood that devices according to the present invention can also be used with non-collimated light beams.

Figure 2:
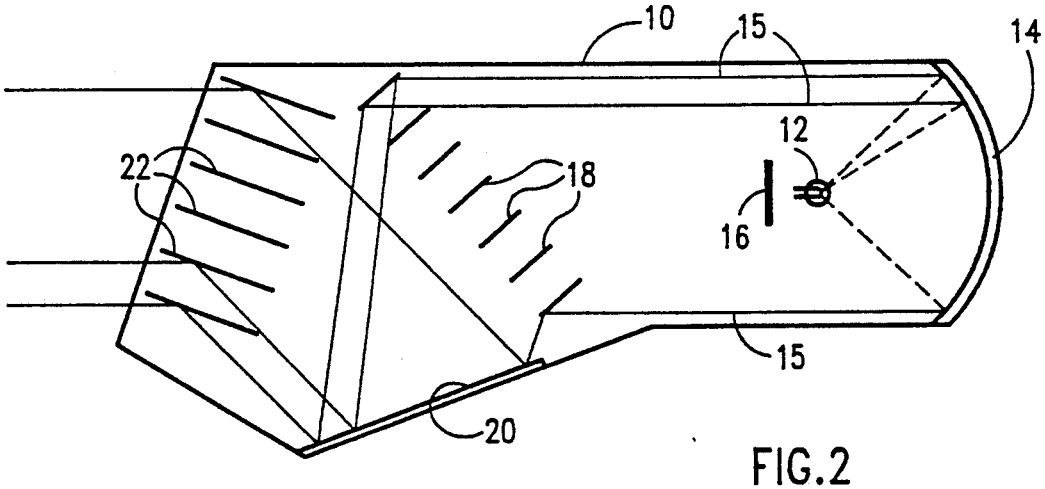
FIG. 2 is a view as in FIG. 1 but further including a schematic depiction of the path of a few representative light rays.

Typically, the means for producing a collimated light beam is in the form of a point light source, such as an incandescent light bulb 12 and a parabolic reflector 14 having its focus at the point light source. Light leaving the bulb 12 in the posterior direction impinges parabolic reflector 14 and forms a collimated light beam which is directed anteriorly. Several rays of the collimated light beam are shown in FIG. 2 and are designated 15. Light leaving bulb 12 in a direction so as not to impinge upon parabolic reflector 14 may be blocked by light shield 16 mounted anteriorly of bulb 12 and/or may be absorbed by the walls of housing 10.

The collimated light beam directed anteriorly and substantially horizontally after having been reflected by parabolic reflector 14 next impinges upon a first set of slats 18 mounted within housing 10. First set of slats 18 extend over the entire width of housing 10 and are sized and oriented so that all the rays forming the collimated beam are intercepted by the posteriorly-directed surface of one of the slats. Thus, no portion of the collimated beam is able to escape from housing 10 without being reflected by first set of slats 18.

The posteriorly-directed surfaces of each of the slats is preferably reflective. The slats may be made of any convenient material, such as reflective metal or silvered glass or plastic. The orientation of the slats relative to the horizontal collimated light beam is selected with a view toward reflecting the entire collimated light beam into a reflector 20. First set of slats 18 are preferably oriented at an angle of from about 30° to about 50° to the horizontal collimated light beam, most preferably from about 35° to about 45°.

The relative angles of first set of slats 18, of second set of slats 22 and of reflector 20 may be chosen from a large set of angles which will ensure that the angles of first set of slats 18 and of second set of slats 22 with the horizontal are sufficiently large so as to keep the number and/or extent of slats within a reasonable bound, while at the same time ensuring that rays of light are not able to leave the device directly without being reflected by the various reflective surfaces.

The relatively large angles are of great importance since they greatly facilitate the compact and inexpensive construction of headlights according to the present invention. To better appreciate this, it is useful at this point to distinguish the present invention from those, mentioned briefly in the background section above.

The prior art discloses anti-glare automobile headlights which feature a set of slats placed so as to intercept a collimated light beam and direct the light downward. The difficulty with the prior art designs is that such designs are impracticable where it is desired to project light for a considerable distance ahead of the vehicle.

The early devices were designed shortly after automobiles first appeared on the market. These designs may have been appropriate then since the early automobiles were capable of travelling only at very low speeds which meant that the light needed to be directed only a few 15 meters in front of the vehicle. Furthermore, the early headlights were mounted at relatively large distance above the ground which made it easier to point the light toward the ground.

By contrast with the early automobiles, today's cars have a lower profile which places the headlights considerably closer to the ground. Perhaps more importantly, today's cars are designed to travel at much higher speeds, which requires that the headlights illuminate the roadway for a much larger distance in front of the car than was heretofore necessary.

If the early headlight designs involving glare-reducing slats were to be used today, the combination of the lower position of the modern headlights and their longer illumination range, would make it necessary to use slats oriented at extremely small angles from the horizontal. For example, an early automobile may have had its headlights mounted one meter above the ground and may have required the illumination of a zone extending 10 meters in front of the headlights, which translates to a slat angle of 5.71° from the horizontal. By contrast, a modern automobile may have its headlight mounted 50 cm above the ground and may require the illumination of a zone spanning 100 meters ahead of the headlights, which translates to an angle of only 0.29° from the horizontal.

The angle from the horizontal has important implications for the practicability of the structure since the slats must be such that all the rays of the collimated beam are intercepted by the slats. Thus, assuming the slats have virtually no thickness, and assuming a headlight having a collimated beam which is 10 cm in height, a prior art device used in a headlight of an early model automobile would have to have a total slat expanse, i.e., the total width of all the individual slat segments, of approximately 1 meter. By contrast, a prior art device used in a modern automobile would have to have a total slat expanse of approximately 20 meters. This would require each headlight to contain a large number of very thin closely spaced slats, or, alternatively, would require that the headlights physically extend along the direction of the collimated light beam to a much greater extent than otherwise, both of which eventualities would render the device impracticable.

A device according to the present invention overcomes the difficulty described above by using two pairs of slats, each with relatively large angles from the horizontal, and a reflector between the two sets of slats. In this way, each set of slats can be made up of a relatively small number of relatively short slat segments. One possible arrangement can be seen in FIGS. 1 and 2.

The light reflected from the posteriorly-directed surfaces of first set of slats 18 impinges on reflector 20. Reflector 20 is oriented relative to the horizontal collimated light beam such that the light reflected from reflector 20 is directed toward a second set of slats 22 mounted within housing 10. Second set of slats 22 may be built into the front face of housing 10.

Second set of slats 22 extend over the entire width of housing 10 and are sized and oriented so that all the rays coming from reflector 20 are intercepted by the posteriorly-directed surface of one of the slats. Thus, no portion of the light coming from reflector 20 is able to escape from housing 10 without being reflected by second set of slats 22.

As is the case with first set of slats 18, the posteriorly-directed surfaces of each of the slats of second set of slats 22 are flat and is reflective. The slats may be made of any convenient material, such as reflective metal or silvered glass.

While the use of a device according to the present invention such as that described above generally obviates the need to have the capability of alternating between high beams and low beams, it may still be desirable to have the ability to control the range of the produced light beam. This may be easily accomplished with a device according to the present invention by providing means (not shown) for rotating reflector 20 about a horizontal pivot line (not shown) relative to its position as shown in FIGS. 1 and 2. Thus, rotating reflector 20 clockwise or counterclockwise about its anterior or posterior edge would result in an exiting light beam which extends farther or closer than when reflector 20 is located as shown in FIGS. 1 and 2.

Figure 3:
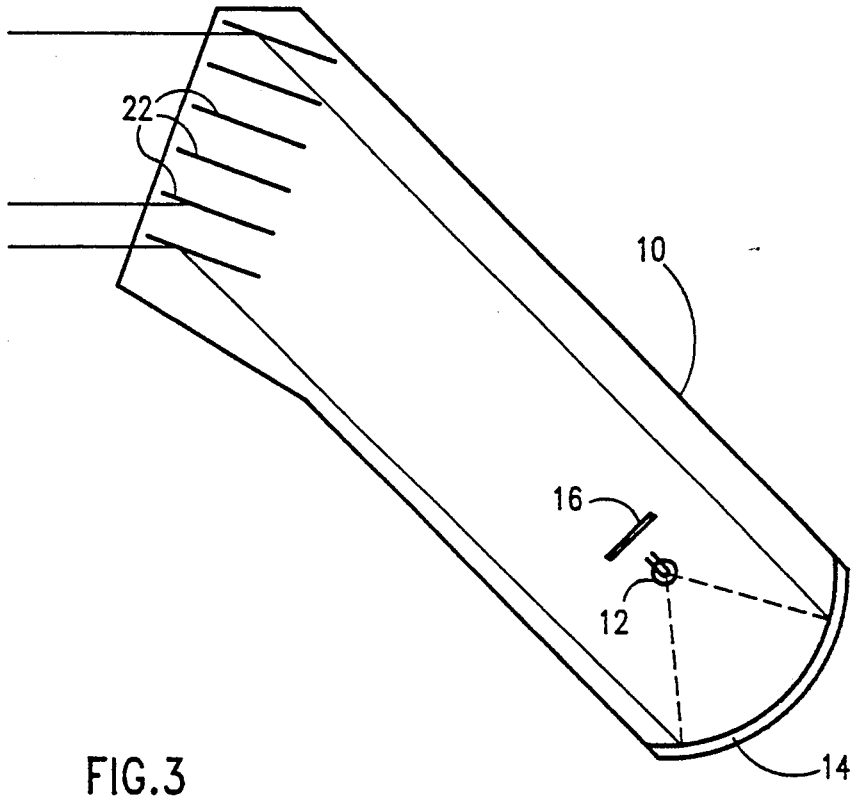
FIG. 3 is a view showing another embodiment of a light source according to the present invention featuring a single set of slats.

A second embodiment is of a device according to the present invention is shown in FIG. 3. A device according to this embodiment has the advantage that the first set of slats and the reflector have been eliminated, leaving only second set of slats 22. In this respect, this embodiment is similar to some of the prior art references cited above. However, unlike those prior art disclosures, the slats of the second embodiment according to the present invention features angles with the horizontal which are quite large, thereby greatly reducing the number and/or extent of slats required.

To achieve the large angles desired, bulb 12 is located below second set of slats 22 and projects a collimated light beam upwards and forwards toward the slats, such that the collimated light impinges upon second set of slats 22 at a relatively large angle, preferably no smaller than about 30°. While this design is simpler than the first embodiment, it does dictate a shape for the overall device which is significantly different from present-day automobile head lamps. However, such a configuration may be acceptable in other applications or in newly designed automobiles.

While the invention has been described with respect to two basic preferred embodiments, it will be appreciated that many variations, modifications and other applications of the invention may be made. For instance, it may desirable to allow some light to leave a headlight according to the present invention in a direction which will result in the light impinging the eyes of the driver of an oncoming car so as to alert the driver of the oncoming car of the presence and location of the car featuring the headlights according to the present invention.

What is claimed is:

1. A glare-reducing light source, comprising:

(a) a means for producing a substantially horizontal light beam;

(b) a first set of reflective slats for reflecting said light beam, forming a once reflected light;

(c) a reflector for reflecting said once reflected light, forming a twice reflected light; and (d) a second set of reflective slats for reflecting said twice reflected light forming a thrice reflected light.

2. A light source as in claim 1 wherein said first set of reflective slats is of such an angle relative to said light beam and of such a length that all of said light beam is reflected by said first set of slats.

3. A light source as in claim 1 wherein said second set of reflective slats is of such an angle relative to said light beam and of such a length that all of said twice reflected light is reflected by said second set of slats.

4. A light source as in claim 1 wherein said first set of reflective slats is oriented at an angle of from about 30° to about 50° relative to said light beam.

5. A light source as in claim 1 wherein said reflector is rotatable.

6. A light source as in claim 1 wherein said means for producing a substantially horizontal light beam includes an incandescent light bulb and a parabolic reflector.

7. A light source as in claim 6 wherein said means for producing a substantially horizontal light beam further includes a direct light shield mounted anteriorly of said light bulb.

* * * * *